United States Patent [19]

Smith

[11] 4,318,527

[45] Mar. 9, 1982

[54] COLLAPSIBLE SUPPORT STRUCTURES

[76] Inventor: Donald B. Smith, R.R. No. 1, Mount Brydges, Ontario, Canada, N0L 1W0

[21] Appl. No.: 154,083

[22] Filed: May 28, 1980

[51] Int. Cl.[3] ..... F21K 2/21

[52] U.S. Cl. ..... 248/459; 248/460

[58] Field of Search ..... 248/174, 459, 460, 461

[56] References Cited

U.S. PATENT DOCUMENTS

| | | | |
|---|---|---|---|
| 790,066 | 5/1905 | Lichter | 248/459 |
| 844,066 | 2/1907 | Warren | 248/459 |
| 1,515,508 | 11/1924 | Medick | 248/459 |
| 1,652,326 | 12/1927 | Pollock | 248/174 |
| 2,587,316 | 2/1952 | Henry | 248/459 |
| 3,269,043 | 8/1966 | Swanson | 248/460 X |
| 3,990,669 | 11/1976 | Smith | 248/459 |
| 4,002,237 | 1/1977 | Nichols | 248/459 X |

*Primary Examiner*—William H. Schultz

*Attorney, Agent, or Firm*—Weldon F. Green

[57] ABSTRACT

The invention relates to improvements in lightweight collapsible support structures in the nature of easels, book rests and the like which are self sustaining in a predetermined fully erected configuration, presenting in the fully erected configuration a multiplicity of forwardly facing panels upstanding in a rearwardly inclined or substantially vertical position to provide support surfaces for the displaying, supporting or anchoring of articles such as pads, books or the like and further presenting forwardly extending ledge portions from the bottom edges of such abutment surfaces, said ledges serving to rigidify and stabilize the erect configuration of these structures against collapse, but so adapted as to be foldable into a position allowing for such structures to be compactly folded up and collapsed for storage or for carrying when not in use.

12 Claims, 13 Drawing Figures

COLLAPSIBLE SUPPORT STRUCTURES

FIELD OF INVENTION

This invention relates to improvements in lightweight collapsible support structures in the nature of easels, book rests, book ends or similar articles that upon unfolding and erection provide upstanding inclined or substantially vertical support or abutment surfaces for display purposes or for supporting or anchoring articles such as pads, books or similar items.

BACKGROUND TO THE INVENTION

Lightweight collapsible structures useful for a variety of purposes have been disclosed in a number of U.S. patents and Canadian patents exemplified by the following:

U.S. Pat. No. 433,635 issued August 1890;
U.S. Pat. No. 844,066 issued February 1907;
U.S. Pat. No. 1,875,460 issued September 1932;
U.S. Pat. No. Re. 21,371 issued February 1940;
U.S. Pat. No. 2,587,316 issued February 1952;
Canadian Pat. No. 312,291 issued June 1931;
Canadian Pat. No. 315,615 issued Sept. 29, 1931;
Canadian Pat. No. 641,733 issued May 1962.

This invention relates to improvements in such collapsible structures but particularly of the nature disclosed in my U.S. Pat. No. 3,990,669 which issued Nov. 9, 1976 and the Canadian counterpart, Canadian Pat. No. 1,010,008 issued May 10, 1977.

OBJECTS OF THE INVENTION

The principal object of this invention is to provide an improved, self-sustaining, lightweight collapsible support structure including several hingedly interconnected panels adapted upon being extended from a folded state to assume a substantially independent upright stable configuration presenting a principal surface of generally planar configuration from several panels either inclined or supported substantially vertically for display purposes or as a support abutment surface for pads or books or the like.

It is another very important object to provide an improved collapsible support structure of the type described which folds compactly for storing or for shipping or carrying but upon being unfolded and extended and deposited upon a suitable supporting surface assumes a stable configuration.

Still another object is to provide a support structure of minimal components readily unfolded and extended into its stable configuration and vice versa.

Still another important object is to provide a support structure which can be produced in several configurations for particular uses each having an overall appearance that is pleasing.

Still another object is to provide support structures capable of being fabricated from stiff lightweight sheet materials using fundamental manufacturing steps and apparatus which ensure efficiency in production.

FEATURES OF THE INVENTION

The principal feature of this invention resides in providing in a collapsible self-sustaining support structure having a substantial measure of rigidity derived from sheet-like panel portions hingedly interconnected along their common abutting edges to define fold axes for limited swinging movement towards and away from one another, a central panel portion flanked by hingedly interconnected side panel portions which are arranged to be supported in substantially fully extended upstanding side-by-side relation in which the central panel portion has a uniform generally quadrilateral perimetral configuration with its uppermost edge having an extent greater than the extent of its lowermost edge, the central and side panel portions flanking same each presenting hingedly interconnected ledge panel portions along their respective lowermost edges in side-by-side relation with the configuration of the lowermost edges being such that the hingedly inter-connected ledge panel portions are foldable in unison into a generally horizontal disposition only when the aforementioned central and side panel portions are in substantially fully extended side-by-side relation.

The aforementioned structure provides a relationship of panels whose relative positions can be fixed or secured against displacement through the manipulations outlined and when deposited upon a flat supporting surface is sufficiently rigid and stable so as to support or accommodate articles for display or books or in certain embodiments serve as book ends.

It is also a feature within the structure embodying the invention to provide through selected dimensioning of the principal central panels a range of self-sustaining configurations useful for a variety of purposes as earlier mentioned.

Still another feature resides in providing multiple or compound fold axes between the principal central panels and associated side or gusset panels whereby upon collapse and folding of the panel portions one upon the other one section can be received within the other whereby compactness may be readily achieved.

Still another feature resides in providing structures of the type indicated which can be cut or struck from a single sheet of suitable material with fold lines defining fold axes inscribed or impressed therein whereby jointing, bonding or interconnecting of only a minimum number of panel portions is required.

These and other objects and features are to be found in the following description to be read in conjunction with the accompanying sheets of drawings in which:

DRAWINGS

Figure 9:
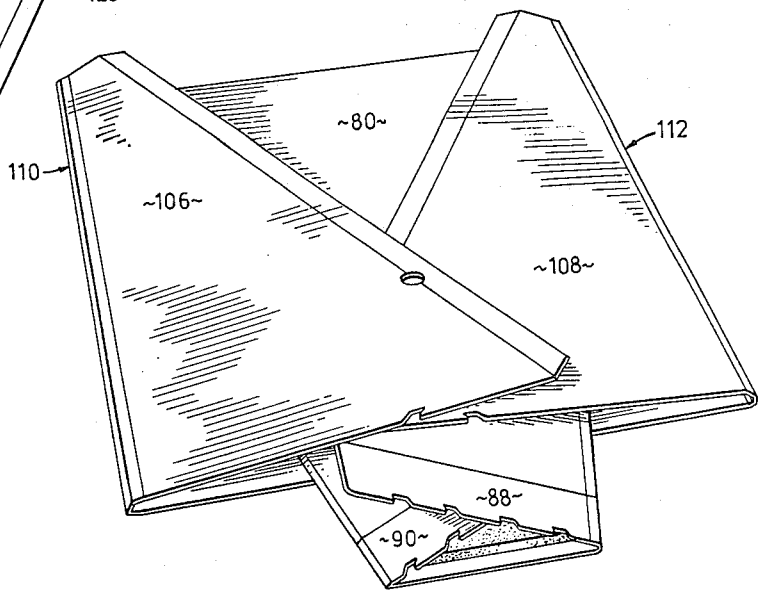
FIG. 9 is a perspective view of the support structure of FIGS. 6 and 7 with the outermost side panel portions and associated ledge panel portions folded over upon each other and upon the central panels illustrating the fully collapsed position.
Figure 10:
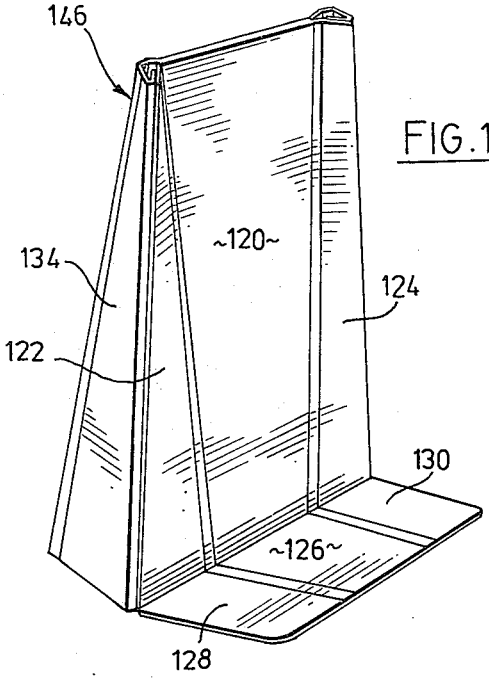

FIG. 10 is a perspective view of still another preferred form of support structure embodying the invention which is similar to the support structure illustrated in FIGS. 6 to 9 inclusive except that the arrangement of three forwardly facing panel portions extends substantially vertically in the fully erect stable dispostion and with the forwardly presented ledge formation at substantially right angles to the aforementioned panel portions.

Figure 11:
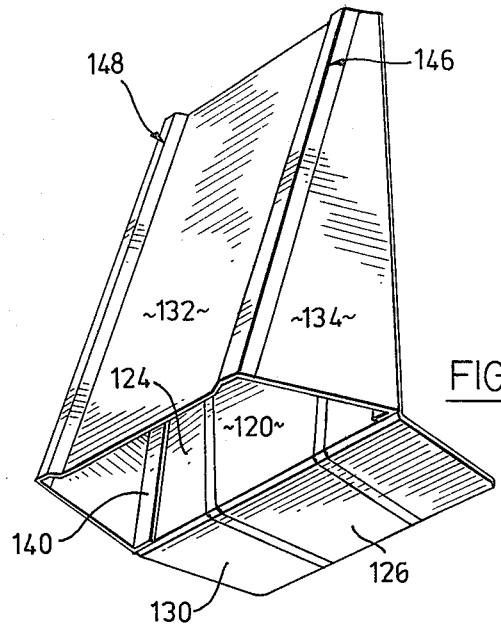

FIG. 11 is a perspective view of the embodiment of FIG. 10 taken from a point to the rear and left below same.

Figure 12:
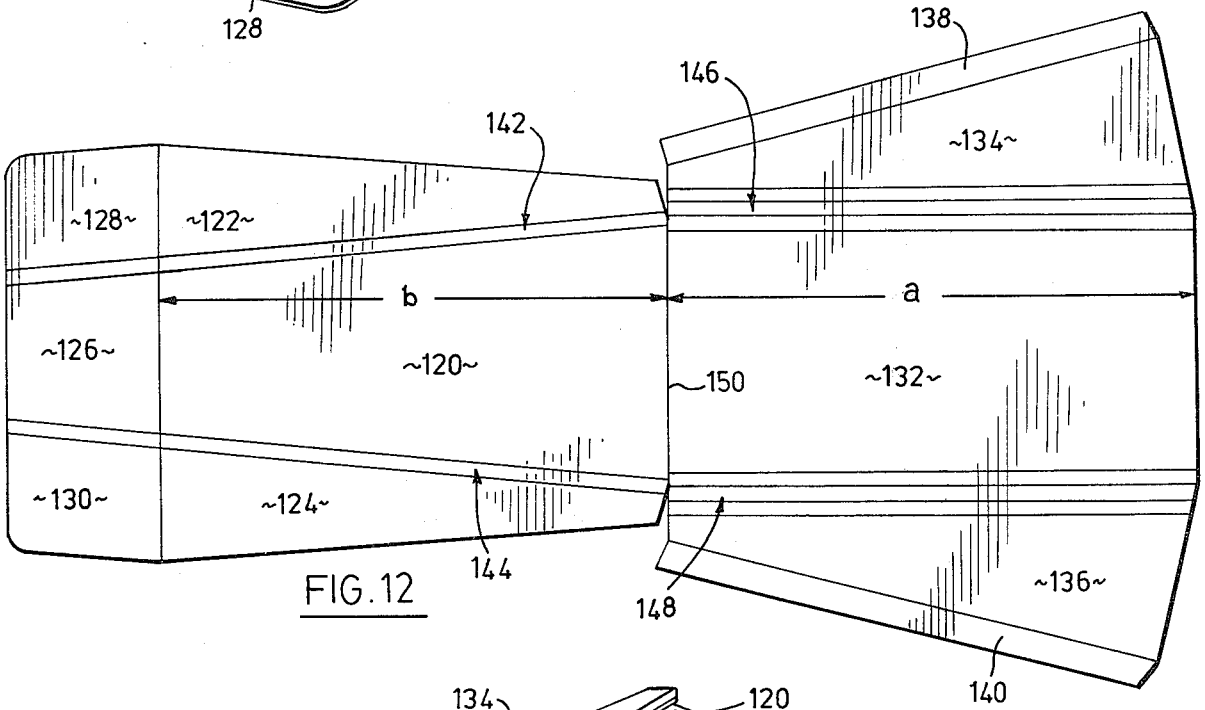

FIG. 12 is a plan view of a flattened sheet of suitable material having a perimetral configuration and impressed or inscribed with fold axes from which the support structure of FIGS. 10 and 11 is derived.

Figure 13:
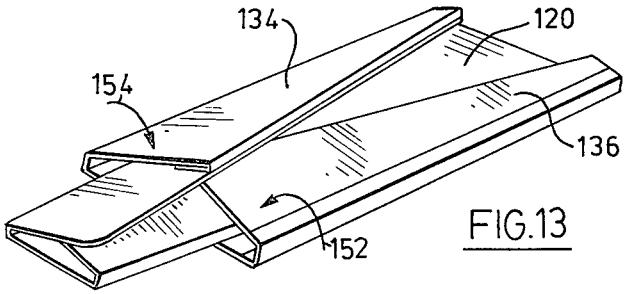

FIG. 13 is a perspective view of the support structure of FIGS. 10 and 11 with the extended outermost side panels and associated ledge panel portions folded over upon each other in the manner indicated by the arrows and upon the central panels illustrating the fully collapsed disposition thereof.

DESCRIPTION OF THE INVENTION

Figure 2:
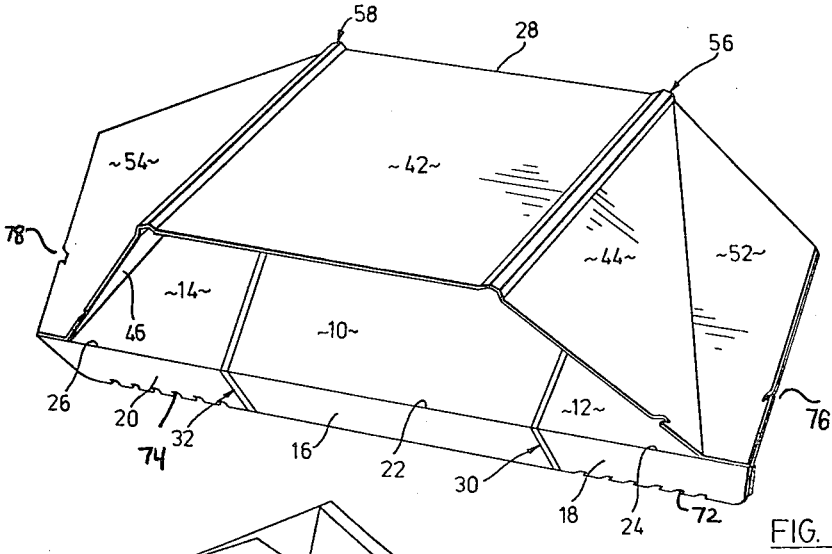
FIG. 2 is a perspective view of the support structure of FIG. 1 taken from a point to the rear and to the left below the support structure as viewed in FIG. 1.
Figure 3:
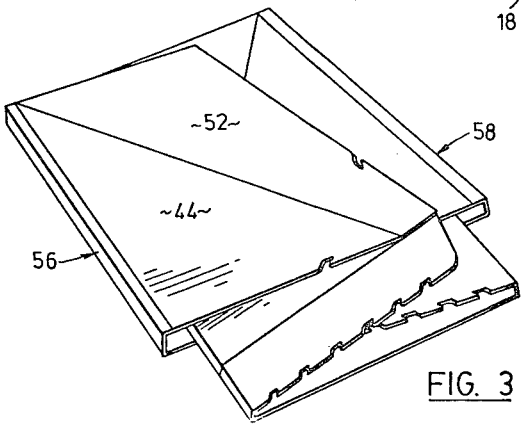
FIG. 3 is a perspective view of the support structure of FIGS. 1 and 2 with the outermost side panel portions and associated ledge panel portions folded over upon each other and upon the central panels illustrating the fully collapsed position of same.

The several embodiments of the support structures illustrated in FIGS. 1 to 13 inclusive, when unfolded and secured in the preferred configuration against collapse and deposited upon a suitable supporting surface are independently self-sustaining notwithstanding that they can be readily folded up compactly as illustrated in FIGS. 3, 9 and 13 respectively.

All embodiments illustrated and described are intended to be cut from a single stiff sheet of suitable material such as polyethylene or equivalent plastic sheeting or from suitable stiff cardboard sheeting.

Where desired the panel portions may take the form of stiff rigid perimetral inserts encased in suitable plastic sheeting or like material with the respective fold axes of such composite article being defined by several thicknesses of such sheeting formed together by sealing or by stitching or otherwise adhered.

The fold axes or hinged interconnections are coincident with the panel portion edges. According to the preferred approach which utilizes suitable stiff plastic sheeting the fold axes are defined by impressing or inscribing lines in such plastic sheeting in the die cutting operation. This leaves a minimal number of joints to be fabricated by heat sealing or by using appropriate adhesives.

The Embodiment of FIGS. 1 to 5 inclusive

Figure 4:
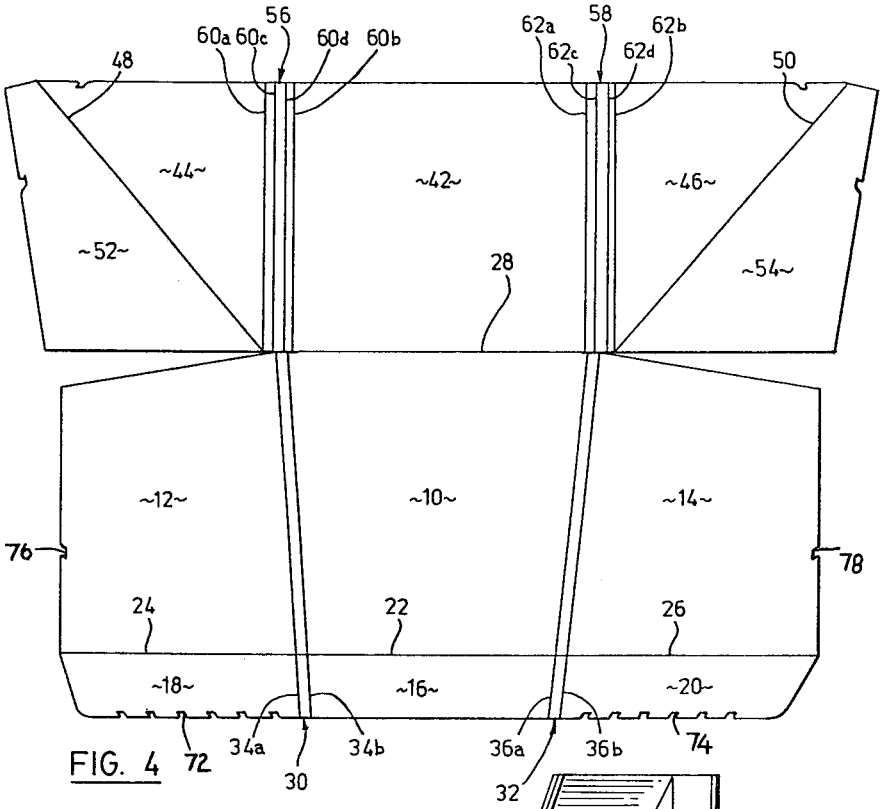
FIG. 4 is a plan view of a flattened sheet of suitable material having a perimetral configuration and impressed or inscribed with lines defining fold axes from which the support structure of FIGS. 1, 2 and 3 is derived.

The embodiment of FIGS. 1 to 5 inclusive is preferably derived from a one-piece layout or blank having the configuration illustrated in FIG. 4.

The blank of FIG. 4 includes a centrally located first panel portion 10 flanked by side panel portions 12 and 14 of opposite symmetry, along each of panel portions 10, 12 and 14 are presented integral ledge panel portions 16, 18 and 20 along lowermost edges 22, 24 and 26 respectively.

Central panel portion 10 has a uniform generally quadrilateral configuration with uppermost edge 28 thereof having a greater extent than lowermost edge 22 such that side edge formations separating the respective associated central and side panel portions and ledge panel portions generally indicated at 30, 32 are angled convergingly downwardly respectively and are constituted by pairs of impressed or inscribed fold lines indicated at 34*a*, 34*b*, 36*a* and 36*b* in FIG. 4.

Hingedly connected along uppermost edge 28 constituted by an impressed or inscribed fold line as indicated in FIG. 4 is a second central panel portion 42 adapted to support first mentioned central panel portion 10 in upstanding relation as may be better understood from FIG. 2 of the drawings. The hinged connection of the two central panel portions 10 and 42 allows for swinging movement of the central panel 10 with respect to the central panel 42 first forwardly from a next adjacent folded position to an inclined position, and then reversely when the structure is to be collapsed.

The preferred embodiment reveals a hinged connection along uppermost edge 28, whereas this connection may be omitted to provide a gap or slot therebetween for the reception of a flap or cover by means of which a pad can be anchored against dislodgement.

Central panel 42 is flanked by and hingedly connected to generally triangularly shaped side panel portions or gussets 44 and 46 which present along their respective hypotenuses as at 48 and 50 anchoring panel portions 52 and 54 which are adapted to be secured in abutting relation against the respective rear surfaces side panel portions 12 and 14 as best seen in FIG. 2 of the drawings.

The hinged connections extending along side edges of central panel portion 42 and flanking side panel portions 44 and 46 as indicated generally at 56 and 58 in FIG. 4 comprise separated pairs of fold lines in the case of hinge connections 56 as at 60*a*, 60*b*, 60*c* and 60*d* and in the case of hinge connection 58 as at 62*a*, 62*b*, 62*c* and 62*d*.

The hinged connections 56 and 58 so defined have an extent so as to embrace the enclosed central panel portions 10 and 42 and associated side panel and gussets when the support structure is collapsed as revealed by FIG. 3 of the drawings.

Also such hinged connections 56 and 58 add stability derived from the assumed column or shaping when the article is extended into the fully erect position revealed by FIG. 2.

Figure 1:
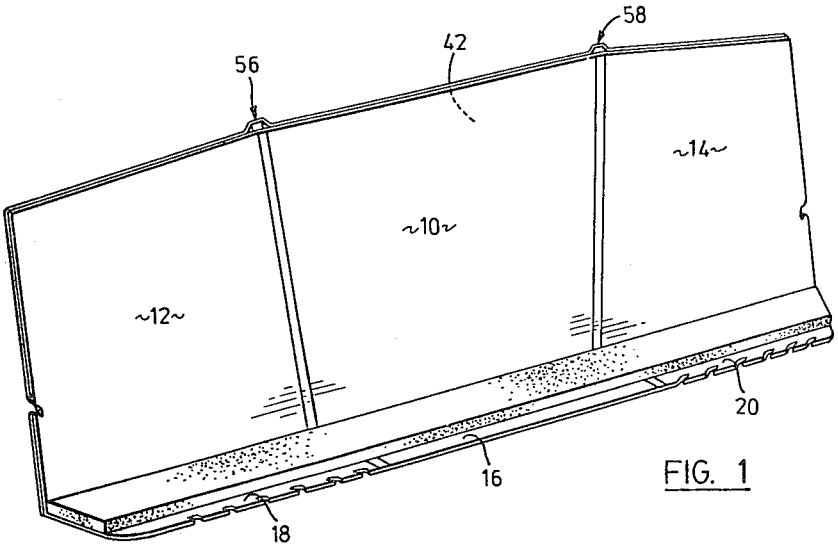
FIG. 1 is a perspective view of one preferred form of support structure embodying the invention in extended erect stable disposition illustrating one arrangement of three forwardly facing inclined panel portions with the lowermost locking ledge panel portions extending forwardly.
Figure 5:
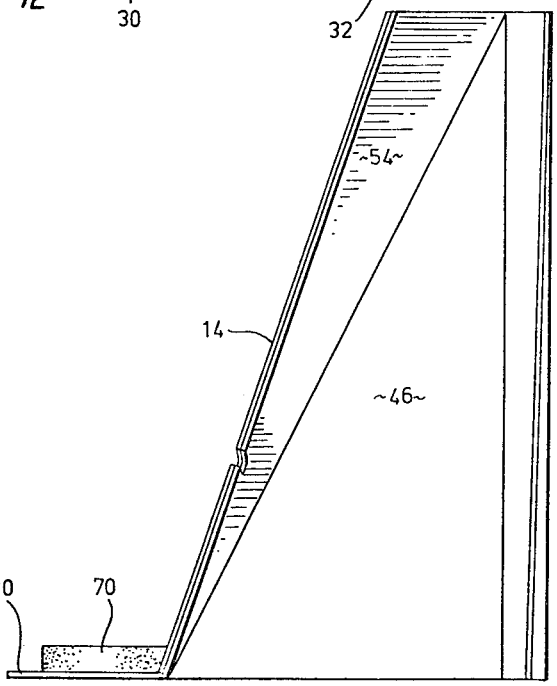
FIG. 5 is an end elevational view of the support structure of FIG. 1 taken from the right side thereof.

It will be observed from the layout or blank of FIG. 4 from which the article of FIGS. 1, 2, 3 and 5is derived that by joining panel portions 52 and 54 to the rear surfaces of panel portions 12 and 14 along their abutting surface shown particularly in FIG. 2 that alignment of lower deges 22, 24 and 26 of panel portions 10, 12 and 14 respectively can be established only when they are arranged in substantially fully extended coplanar side-by-side relation emphasized in FIGS. 1, 2, and 5 of the drawings. In such fully extended side-by-side relation ledge panel portions 16, 18 and 20 can be folded in unison about their common respective edges or fold axes 22, 24 and 26 which secures panel portions 10, 12 and 14 respectively in substantially fully extended coplanar relation against collapse thereby inherently preserving the erect configuration, which structure so defined has a loading capability, and resists deformation when deposited upon a suitable supporting surface.

The support structure of FIGS. 1 to 5 inclusive is intended to carry an opened book supported lowermost on a suitable sponge pad 70 or the like mounted upon ledge panel portions 18 and 20 which sponge pad tends to prevent the cover of the book and pages from closing.

Ledge portions 18 and 20 are provided with notches 72 and 74 respectively which notches are adapted to cooperate with notches 76 and 78 respectively presented by side panel potions 12 and 14 in that elastics can be looped around the respective side panel 12 and ledge panel 18 and side panel 14 and ledge panel 20 and anchored in the aforementioned respective notches to hold the leaves or pages from flipping over.

The Embodiment of FIGS. 6 to 9 Inclusive

It will be understood, having regard to the embodiment of the invention illustrated in FIGS. 6 to 9 inclusive, that a modification to the pattern or layout of FIG. 4 may be undertaken without departing from the concept presented by FIGS. 1 to 5.

Figure 8:
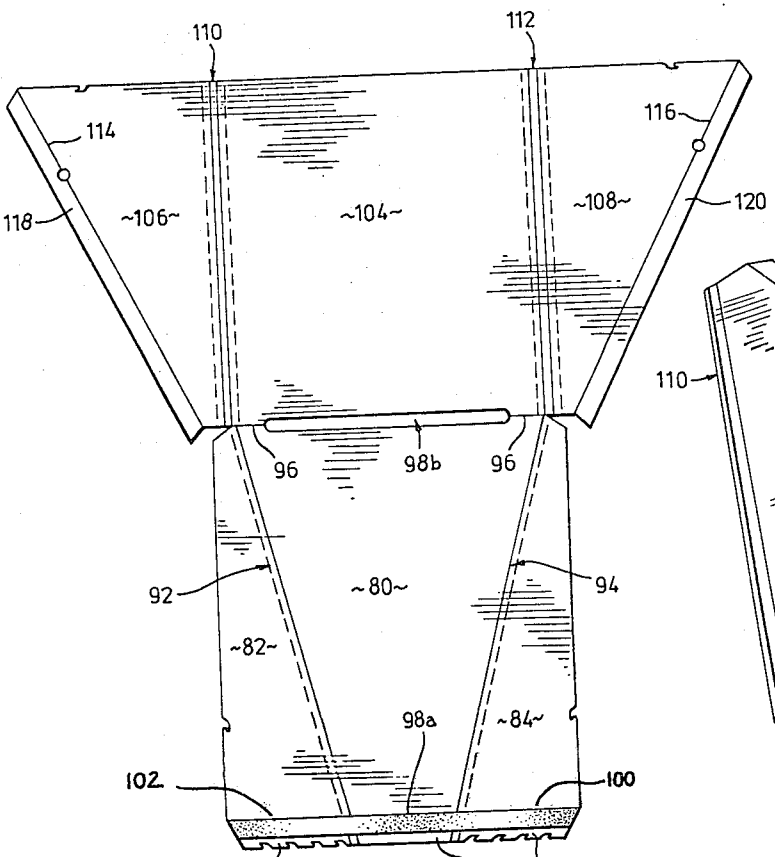
FIG. 8 is a plan view of a flattened sheet of suitable material having a perimetral configuration and impressed or inscribed with fold axes from which the support structure of FIGS. 6 and 7 is derived.

This may be understood first by considering the blank of FIG. 8 which includes the first central panel portion 80 flanked by and hingedly connected to side panel portions 82 and 84 each presenting hingedly inter-connected ledge panel portions 86, 88 and 90 lowermost respectively.

Fold axes formations indicated generally at 92 and 94 of FIG. 8 separate panel portions 80 from side panel portions 82 and 84 respectively with the uppermost edge 96 of central panel portion 80 constituting a fold axis of perimetral extent greater than the perimetral extent of lowermost edge 98*a* but provided with a slotted arrangement as at 98*b*.

Lowermost edge 98*a* defining the fold axis between central panel portion 80 and ledge panel portion 86 in the fully extended disposition is aligned with the fold axes 100 and 102 of ledge panel portions 88 and 90 respectively.

Central panel portion 80 is hingedly connected along the unslotted portion of uppermost edge 96 to a second central panel potion 104 flanked by gussets 106 and 108 along hinged connections 110 and 112 respectively in the same manner as described in relation to the embodiment of FIGS. 1 to 5 exclusive.

Figure 7:
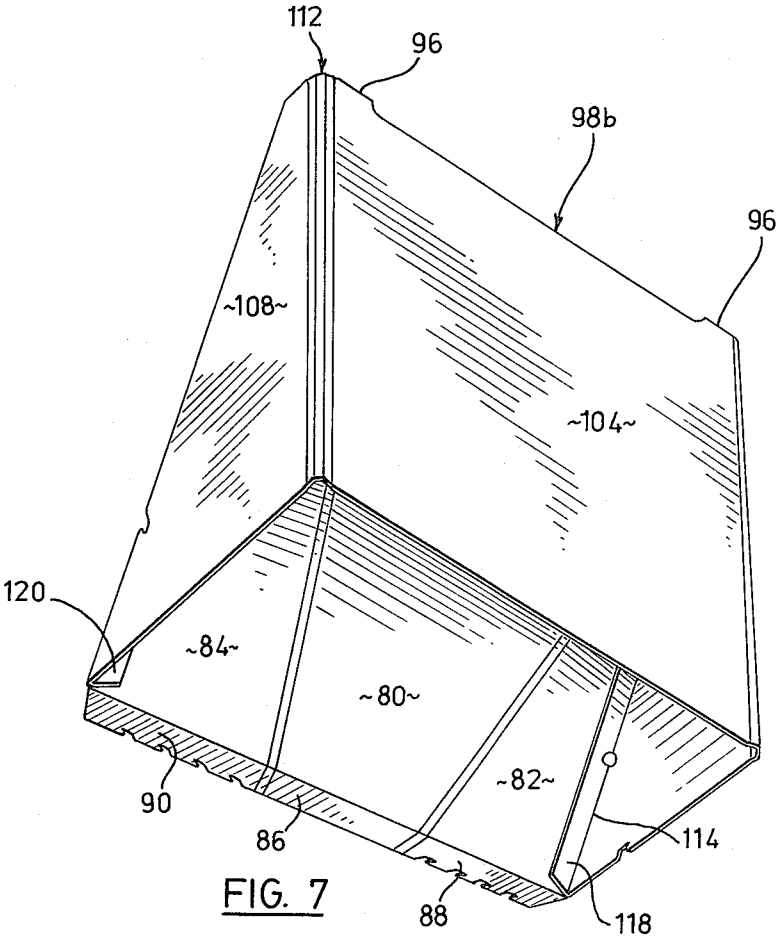
FIG. 7 is a perspective view of the embodiment of FIG. 6 taken from a point to the rear and to the right below same.

Gussets 106, 108 present securing panel portions 118 and 120 separated by fold lines 114, 116 respectively which are adapted to be secured to panel portions 82 and 84 respectively of central panel portion 80 as best seen in FIG. 7.

Figure 6:
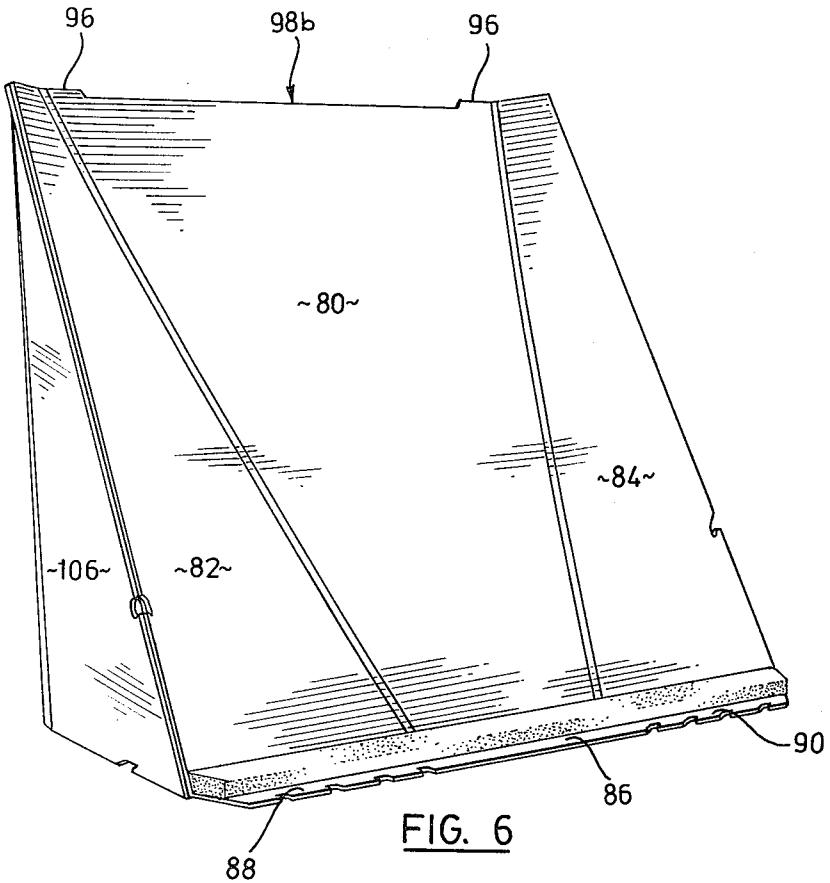
FIG. 6 is a perspective view of the second preferred form of support structure embodying the invention in fully extended erect stable disposition.

Upon erection of the embodiment of FIGS. 6 to 9 inclusive from the collapsed state of FIG. 9 to that of FIGS. 6 and 7 the panel portions are extended to the point where panels 80, 82 and 84 approach fully extended substantial coplanarity and fold axes 98*a*, 100 and 102 of ledge portions 86, 88 and 90 move into alignment for swinging in unison forwardly to secure all panel portions against collapse and so preserve the erect condition of the unit with panel portions 80, 82 and 84 inclined rearwardly from lowermost to uppermost edges and with the slot 98*b* uppermost serving as an aperture for anchoring a note book or pad by its cover to incline downwardly when resting upon same.

The Embodiment of FIGS. 10 to 13 Inclusive

FIGS. 10 to 13 inclusive disclose still another preferred embodiment of the invention.

FIG. 12 illustrates the layout blank used to fabricate the articles depicted in FIGS. 10, 11 and 13 and as with the embodiment of FIGS. 6 to 9 inclusive the layout blank includes a first central panel portion 120 flanked by and hingedly connected to side panel portions 122 and 124 each provided lowermost with ledge panel portions 126, 128 and 130 respectively. The uppermost perimetral edge 150 defines a fold axis along which a second central panel portion 132 is hingedly connected to first central panel portion 120. Central panel portion 132 is also flanked by side panel portions or gussets 134 and 136 carrying outermost connecting panel portions 138, 140 respectively, the fold axes defined by hinge formations 142 and 144 corresponding to those earlier described in connection with the first preferred embodiment of FIGS. 1 to 5 inclusive at 30 and 32 and the fold axes or hinges indicated at 146 and 148 reflecting a structure similar to those indicated at 56 and 58 of the embodiment of FIGS. 1 to 5 inclusive.

The erect support structure depicted in FIGS. 10 and 11 is achieved by securing connecting panels 138 and 140 to the rear surfaces of side panel portions 122 and 124 respectively, as best seen in FIG. 11. So erected, such structure presents front panel portions 120, 122 and 124 in substantially perpendicular relation to the composite forwardly extending ledge formation comprising ledge portions 126, 128 and 130.

This is achieved by selecting a dimension for front central panel portion 120 measured vertically that is less than as indicated at "a" in FIG. 12. The corresponding dimension of rear central panel portion "b" is distinguished from the measurements "a" and "b" of FIGS. 4 and 8 where "a" exceeds "b".

The collapsed configuration of the embodiment of FIGS. 10 to 12 and the direction of folding for that arrangement is as revealed in FIG. 13 by arrows 152 and 154.

In other respects the preferred embodiment of FIGS. 10 to 13 is fabricated and operates in a manner similar to that described in relation to the embodiments of FIGS. 1 to 5 inclusive and 6 to 9 inclusive.

It is emphasized that the substantially fully extended coplanarity achieved in accordance with the embodiments illustrated among the principal panel portions 10, 12 and 14 of FIG. 1 80, 82 and 84 of FIG. 6 and 120, 122 and 124 of FIG. 10 is a limit position and provides automatic alignment of the integral fold axes presented by the respective ledge panel portions which are adapted only in such limit position to move in unison to project forwardly and thereby secure the extended disposition of the respective principal panel portions and associated supporting panel portions to lock same against collapse and impart stability when the article support is deposited upon a suitable support surface.

While the preferred embodiments of the invention have been described and illustrated persons skilled in this field can make variations of alterations in the disclosed structures without departing from the spirit and scope of the invention as defined in the appended claims.

What I claim is:

1. In a collapsible self-sustaining support structure having a substantial measure of rigidity derived from sheetlike panel portions hingedly interconnected along common abutting edges to define fold axes for limited swinging movement towards and away from one another, said structure including a central panel portion flanked by hingedly interconnected side panel portions arranged to be supported in substantially fully extended upstanding side-by-side forwardly facing relation, said central panel portion having a uniform generally quadrilateral perimetral configuration with its uppermost edge having an extent greater than the extent of its lowermost edge, said central panel portion and said side panel portions flanking same each presenting hingedly interconnected ledge panel portions along their respective lowermost edges in side-by-side relation, the configuration of the lowermost edges of said central and side panel portions being such that said hingedly interconnected ledge panel portions are foldable in unison into a generally horizontal disposition only when said aforementioned central and side panel portions are in substantially fully extended side-by-side relation, a second central panel portion having a uniform generally quadrilateral perimetral configuration adapted to swing from a position next adjacent said first mentioned panel portion rearwardly therefrom to support same in upstanding relation and gusset panel portions hingedly interconnected between each of said flanking side panel portions and said second mentioned central panel portion and of an extent whereby with said first mentioned central and side panel portions arranged in substantially fully extended upstanding side-by-side forwardly facing relation the folding in unison of said hingedly interconnected ledge panel portions into a generally horizontal disposition secures said panels against further relative displacement.

2. A support structure according to claim 1 in which said first and second mentioned central panel portions are hingedly interconnected along their respective uppermost edges.

3. A support structure according to claim 1 or 2 in which the extent of said first mentioned central panel portion from its lowermost edge to its uppermost edge exceeds the comparable extent of said second mentioned central panel portion, such that with said central panel portions swung apart and secured against further relative displacement and with their lowermost edges in surface engaging relation, said second mentioned central panel portion assumes a substantially upright disposition and said first mentioned central panel and flanking side panel portions are inclined downwardly and forwardly.

4. A support structure according to claim 1 or 2 in which the extent of said first mentioned central panel portion from its lowermost edge to its uppermost edge is less than the comparable extent of said second mentioned central panel portion such that with said central panel portions swung apart and secured against further relative displacement and with their lowermost edges in surface engaging relation, said first mentioned central panel and flanking side panel portions assume a substantially upright disposition and said second mentioned panel is inclined downwardly and rearwardly from its uppermost edge.

5. A support structure according to claim 1 or 2 in which said gussett panel portions extend between the respective side edges of said second mentioned central panel portion and the edges of said flanking side panel portions remote from said first mentioned central panel portion.

6. A support structure according to claim 1 or 2 in which said gusset panel portions extend between the respective side edges of said second mentioned central panel portion and the rearwardly facing surfaces respectively of said flanking side panel portions along a diagonal line of juncture.

7. A support structure according to claim 1 or 2 in which the hinged interconnections between said first mentioned central panel portion, flanking side panel portions and ledge panel portions each comprise at least two next adjacent substantially parallel fold axes and the hinged interconnections between said second mentioned central panel portion and said gussett panel portions respectively include at least two or more next adjacent substantially parallel fold axes.

8. A support structure according to claim 1 in which said gusset panel portions extend between the respective side edges of said second mentioned central panel portion and the edges of said flanking side panel portions remote from said first mentioned central panel portion, said first and second mentioned central panel portions being hingedly interconnected along their respective uppermost edges, with the extent of said first mentioned central panel portion from its lowermost edge to its uppermost edge exceeding the comparable extent of said second mentioned central panel portion, so that with said central panel portions swung apart and secured against further relative displacement and with their lowermost edges in surface engaging relation, said second mentioned central panel portion assumes a substantially upright disposition and said first mentioned central panel and flanking side panel portions are inclined downwardly and forwardly.

9. A support structure according to claim 1 in which said gusset panel portions extend between the respective side edges of said second mentioned central panel portion and the edges of said flanking side panel portions remote from said first mentioned central panel portion, said first and second mentioned central panel portions being hingedly interconnected along their respective uppermost edges with the extent of said first mentioned central panel portion from its lowermost edge to its uppermost edge being less than the comparable extent of said second mentioned central panel portion, so that with said central panel portions swung apart and secured against further relative displacement and with their lowermost edges in surface engaging relation, said first mentioned central panel and flanking side panel portions assume a substantially upright disposition and said second mentioned panel is inclined downwardly and rearwardly from its uppermost edge.

10. A support structure according to claim 1 in which said gusset panel portions extend between the respective side edges of said second mentioned central panel portion and the rearwardly facing surfaces respectively of said flanking side panel portions along a diagonal line of juncture, and in which said first and second mentioned central panel portions are hingedly interconnected along their respective uppermost edges with the extent of said first mentioned central panel portion from its lowermost edge to its uppermost edge exceeding the comparable extent of said second mentioned central panel portion, so that with said central panel portions swung apart and secured against further relative displacement and with their lowermost edges in surface engaging relation, said second mentioned central panel portion assumes a substantially upright position and said first mentioned central panel and flanking side panel portion are inclined downwardly and forwardly.

11. A support structure according to claim 8, 9 or 10 in which the hinged interconnections between said first mentioned central panel portion, flanking side panel portions and ledge panel portions each comprise at least two next adjacent substantially parallel fold axes and the hinged interconnections between said second mentioned central panel portion and said gusset panel portions respectively include at least two or more next adjacent substantially parallel fold axes.

12. A support structure according to claim 8, 9 or 10 in which all said panel and ledge portions are integral, derived from a single sheet of material.

* * * * *